United States Patent [19]

Lewis

[11] Patent Number: 4,791,878

[45] Date of Patent: Dec. 20, 1988

[54] FLAGPOLE ASSEMBLY

[75] Inventor: Kenton A. Lewis, Oakland, Calif.

[73] Assignee: C. E. Toland & Son, Oakland, Calif.

[21] Appl. No.: 55,665

[22] Filed: May 29, 1987

[51] Int. Cl.[4] ..... G09F 17/00

[52] U.S. Cl. ..... 116/173; 116/174

[58] Field of Search ..... 40/601; 116/173–175; 248/332; 294/81.1, 81.3, 82.12

[56] References Cited

U.S. PATENT DOCUMENTS

| | | | |
|---|---|---|---|
| Re. 26,779 | 2/1970 | Weichenrieder | 116/63 R |
| 394,983 | 12/1888 | Hurley | 116/173 |
| 421,784 | 2/1890 | Tallman | 116/173 |
| 765,427 | 7/1904 | Herrick | 116/174 |
| 1,069,776 | 8/1913 | Foulis | 116/173 |
| 1,280,078 | 9/1918 | Papy et al. | 116/173 |
| 1,896,832 | 2/1933 | Wiley | 116/173 |
| 2,225,103 | 12/1940 | Einermann | 116/173 |
| 2,327,056 | 8/1943 | Nelson | 116/173 |
| 2,440,500 | 4/1948 | Ellis | 116/173 |
| 2,688,303 | 9/1954 | Leander | 116/174 |
| 2,923,515 | 2/1960 | Farrington et al. | 248/332 |
| 3,418,967 | 12/1968 | Donkersloot | 116/173 |
| 3,599,599 | 8/1971 | Jones | 116/173 |
| 3,675,616 | 7/1972 | McInnis | 116/173 |
| 4,565,152 | 1/1986 | Bennett | 116/50 |

FOREIGN PATENT DOCUMENTS

| | | | |
|---|---|---|---|
| 114519 | 11/1900 | Fed. Rep. of Germany | 116/173 |

*Primary Examiner*—William A. Cuchlinski, Jr.
*Assistant Examiner*—W. Morris Worth
*Attorney, Agent, or Firm*—Townsend and Townsend

[57] ABSTRACT

A flagpole assembly includes a hollow pole and a winch at the base of the pole. A halyard is connected to the winch, extends through the hollow pole and out an exit opening at its tip. The inner edge of the flag is removably mounted to fixed positions along an elongate flag trolley to keep the inner flag edge extended. The flag trolley includes an elongate U-shaped channel to which two pulleys are mounted. The halyard passes from the exit opening, around one pulley, between the legs of the channel and around the other pulley. The outer end of the halyard is fastened to a shock absorbing anchor mounted along the hollow pole. Winding and unwinding the halyard onto and from the winch causes the flag to raise and lower as the length of the halyard between the exit opening and the anchor increases and decreases. The weight of the flag trolley, with or without the flag, is sufficient to pull the halyard from the pole when the winch is unwinding the halyard. The halyard is substantially enclosed except when the flag is being raised and lowered.

18 Claims, 2 Drawing Sheets

FLAGPOLE ASSEMBLY

BACKGROUND OF THE INVENTION

Flags are displayed for many different reasons, on many different occasions and in many different ways. In some situations, such as when the flagpole is inaccessible, it is desirable to use an automatic flagpole, that is one in which the flag is raised and lowered using motorized winches and so forth. Therefore, various types of flagpoles have been developed where the flag is rolled up on a spindle or shaft, such as shown in U.S. Pat. No. 1,280,078 and 765,427, or where the flag is pulled into a tube, as in U.S. Pat. No. 4,565,152, or where the flag is pulled into the flagpole itself, as show in U.S. Pat. No. 2,327,056. Although these automatic flagpoles do make raising and lowering a flag easier, in some cases it would be desirable to substantially eliminate exposed halyard, especially while the flag is flying. None of the existing automatic flagpoles provide this feature.

SUMMARY OF THE INVENTION

Applicant's invention is directed to a flagpole assembly in which the halyard remains substantially concealed from view but allows the flag to be remotely raised and lowered.

The flagpole assembly includes a hollow pole mounted at its base to a support, such as the vertical wall of a building. A first end of a halyard is connected to a winch. The winch is typically mounted at the base of the pole. The halyard passes through the hollow pole and out an exit opening at the pole tip.

The flag has an inner edge adjacent the pole, an outer edge opposite the inner edge and upper and lower edges connecting the inner and outer edges. Guides, preferably pulleys, are secured at the upper and lower ends of the inner edge of the flag. The inner edge of the flag is maintained in an extended condition. This is preferably accomplished by mounting the guides to a stiff, elongate separator member. The halyard passes around the upper pulley, along the inner edge of the flag and around the lower pulley. The second end of the halyard is fastened to an anchor point along the hollow pole.

Paying out the halyard from the winch causes the flag to lower as the length of the halyard extending from the exit opening in the hollow pole increases. The halyard is retracted by winding the halyard onto the winch. If the halyard has a flag attached to it, the flag is raised by this operation. If not, substantially the entire halyard, except for the portion of the halyard extending between the spring-dampened anchor and the exit opening at the pole tip, is housed within the hollow pole or on the halyard winch.

When the halyard is unwound or payed out from the winch, the weight of the flag pulls the halyard through the hollow pole. In many cases it will be desired to add weight to the flag to overcome the friction hindering the movement of the halyard. The flag itself could be weighted along the inner edge. Alternatively, the elongate separator can be made sufficiently heavy so that conventional, unweighted flags could be used. The elongate separator and pulleys constitute a flag trolley which is left on the halyard so to provide sufficient weight to pull down the halyard when no flag is attached to the halyard. The elongate separator of the flag trolley is preferably a U-shaped channel configured so the ends of the legs of the U-channel rest against the pole so to conceal the halyard when the halyard is fully wound on the winch.

A primary advantage of the invention is that it simplifies raising and lowering of a flag while keeping the halyard substantially concealed when the flag is flying and when not. Keeping the halyard substantially concealed reduces the deterioration of the halyard by preventing its being exposed to the elements. It also eliminates problems caused by tangled halyards and flags which can occur, especially in high wind conditions.

The invention is particularly suited for use with building mounted, outwardly extending flagpoles, including a remotely actuated winch housed within the building, to allow the flag to be raised and lowered automatically. However, the invention can also be used with vertical flagpoles if desired.

Other features and advantages of the invention will appear from the following description in which the preferred embodiments have been set forth in detail in conjunction with the accompanying drawings.

DETAILED DESCRIPTION OF THE PREFERRED EMBODIMENTS

Figure 1:
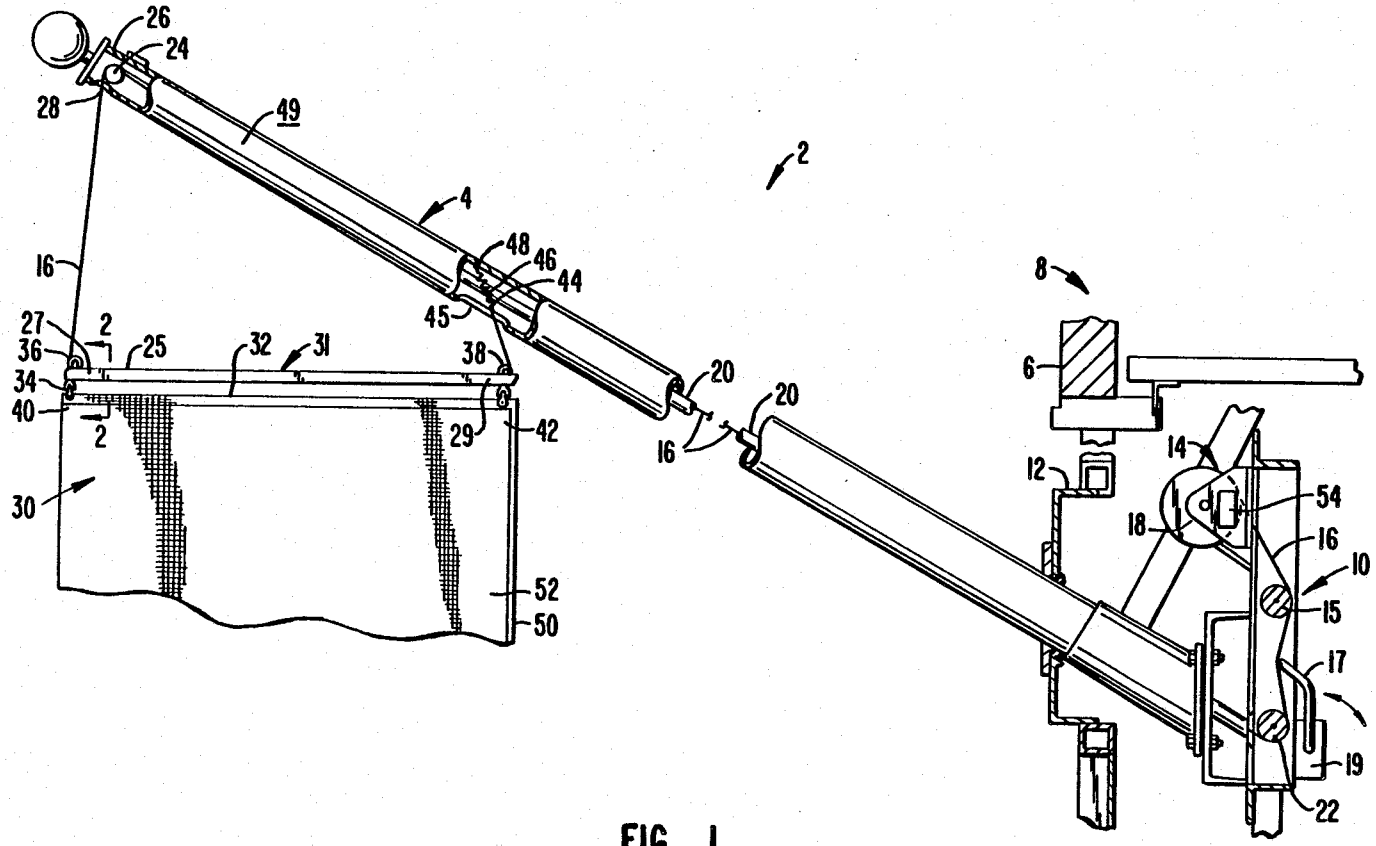
FIG. 1 is a side view of the flagpole assembly of the invention shown mounted to a building with the flag almost completely raised.
Figure 2:
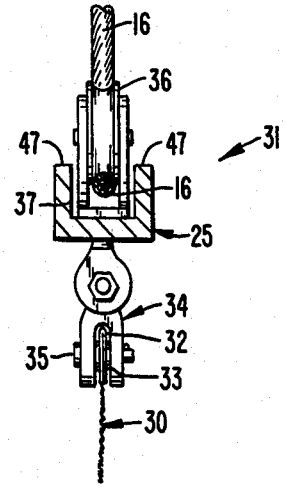
FIG. 2 is a cross-sectional view taken along line 2—2 of FIG. 1.
Figure 3:
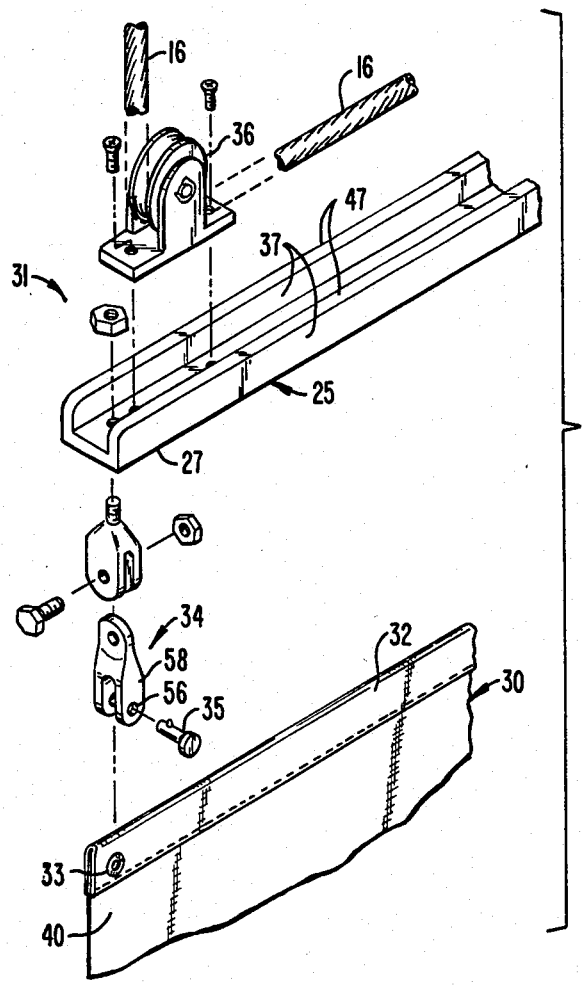
FIG. 3 is an exploded, isometric view of a portion of the flag support assembly of FIG. 1.

Referring now to the figures, a flagpole assembly 2 is shown to include a hollow pole 4 mounted to the side 6 of a building 8 by a pole mounting structure 10. A cover plate 12 is used to conceal the pole mounting structure 10 and a halyard winch 14, which is also mounted to structure 10. A halyard 16 is connected at its first end 18 to halyard winch 14, passes around a first guide pulley 15, past the pivot arm 17 of a tension-sensing limit switch 19, around a second guide pulley 22, through guide conduit 20 mounted within hollow pole 4, a guide pulley 24 at the tip 26 of pole 4 and the an exit opening 28 in the hollow pole.

Halyard 16 supports a flag 30 along the inner edge 32 of through a flag support assembly 31. Assembly 31 an elongate U-shaped channel 25 and articulated pin lock fasteners 34 mounted near the ends 27, 29 of U-channel 25. Fasteners 34 each includes a clevis member 58 having an opening 56 within which a lock pin 35 Edge 32 is folded over and has a grommet 33 the upper and lower ends 40, 42 of edge 32. Edge 3 connected to clevis members 58 of articulated fasteners 34 at grommets 33 using lock pins 35.

Upper and lower pulleys 36. 38 are also secured to U-channel adjacent ends 27. 29. Halyard 16 passes around pulleys 36. 38 and between the sidewalls 37 of U-channel 25 to help conceal and protect the halyard when the U-channel 25 is adjacent pole 4. The second end 44 of halyard 16, after passing around inner pulley 38, passes through an opening 45 in pole 4 and is connected to a spring dampened anchor 46 secured at an appropriate position 48 within pole 4. Anchor 46 reduces some of the peak forces which could otherwise be exerted on halyard 16.

Openings 28. 45 are sized so that the portions of pulleys 36. 38 extending above the edges 47 of sidewalls 37 can pass through openings 28. 45 and into the interior of pole 4. This allows the edges 47 of U-channel 25 to lie against the outer surface 49 of pole 4 so to completely conceal halyard 16 when the halyard is fully wound on winch 14. An antifurling rod 50 is used along the lower edge 52 of flag 30 to help keep the flag from wrapping around pole 4.

In use and assuming halyard 16 is wound onto halyard winch 14, the user lowers halyard 16 by paying out the halyard from winch 14. Winch 14 is preferably an electric winch remotely controlled by the user through a switch 54. The weight of flag support assembly 31 with or without flag 30 is sufficient to pull the payed out halyard around pulley 22, through halyard conduit 20, past guide pulley 24 and out exit opening 28. Halyard conduit 20 helps prevent halyard 16 from fouling or bunching up within hollow pole 4 when the halyard is payed out. Once sufficient halyard 16 has been payed out, so that the user has access to flag support assembly 31, switch 54 is actuated t deactivated winch 14. The user then mounts flag 30 onto halyard 16 by aligning grommets 33 with the openings 56 in the clevis member 58 of pin lock fastener 34 and inserting lock pin 35 through openings 56 and grommet 33. Thereafter, flag 30 is raised by actuating switch 54 thus causing halyard winch 14 to wind halyard 16 onto the winch. End 29 of U-channel 25 will typically come to rest adjacent hollow pole 4 at position 48 before end 27 does. Further winding up of halyard 16 onto winch 14 causes end 27 to be pulled upwardly until edges 47 of U-channel 25 rest against hollow pole 4. Thus halyard 16 is substantially enclosed by being wound onto winch 14, housed within pole 4 or enclosed between U-channel 25 and pole 4. Halyard winch 14 is coupled to limit switch 19 to turn off winch 14 once flag 30 is fully raised to prevent overstressing halyard 16. If desired limit switch 19 could be used to automatically stop halyard winch 14 once flag 30 is lowered by sensing when halyard 16 becomes slack.

Flagpole assembly 2 is shown mounted to side 6 of building 8 so that hollow flagpole 4 extends at an angle to the vertical. However, assembly 2 can also be used for vertical flagpoles. If the flagpole is of sufficient diameter, winch 14 could be mounted within the hollow flagpole. This would be helpful to reduce the length of halyard 16 extending along the flagpole and thus the friction on the halyard and the weight of the halyard below exit opening 28.

Other modification and variation can be made to the disclosed embodiment without departing from the subject of the invention as defined in the following claims. For example, although it is preferred that halyard winch 14 be power-operated and suitable for remote actuation, winch 14 could also be manually driven. Flag support assembly 31 could be configured to be removed with flag 30. If so, an auxiliary weight could be secured to halyard 16, such as by a pulley, to provide sufficient weight on the halyard to pull the halyard from exit opening 28 when the halyard is unwound from winch 14. Also, inner edge 32 of flag 30 could have an integral bar or rod which would keep grommets 33, and thus the associated pulleys or other halyard guides. separated and thus keep inner edge 32 extended.

I claim:

1. A flagpole assembly for mounting to a support comprising a hollow pole, including a base end, a tip and an exit opening at the tip, mounted to the support;

an anchor at a chosen position along the pole;

a winch;

a halyard having first and second ends, the first end connected to the winch, the halyard extending from the winch along the interior of the pole and through the exit opening:

a flag having an inner edge;

first and second guides secured to the flag along the inner edge for movably mounting the flag to the halyard to allow the flag to move freely along the halyard;

means for substantially fully extending the inner edge of the flag at least when the inner edge is adjacent the pole; and the halyard extending from the exit opening, past the first guide, past the second guide and to the anchor, so that winding and paying out the halyard onto and from the winch raises and lowers the flag.

2. The assembly of claim 1 wherein the extending means includes a rigid elongate member to which the flag and the first and second guides are attached, the weight of the elongate member helping to pull the halyard from the pole while the winch is paying out the halyard.

3. A flagpole assembly for mounting to a sppport, comprising:

a hollow pole, including a base end, a tip and an exit opening at the tip, mounted to the support;

an anchor at a chosen position along the pole;

a winch;

halyard having first and second ends, the first end connected to the winch, the halyard extending from the winch along the interior of the pole and through the exit opening;

a flag having an inner edge, the inner edge having an upper end and a lower end;

a flag support assembly including an elongate separator member and first and second guides coupled to the separator member at spaced apart positions, the inner edge of the flag secured to the flag support assembly to maintain the inner edge extended, the guides movably engaged with the halyard so the flag support assembly movably mounts the flag to the halyard to allow the flag to move freely along the halyard; and the halyard extending from the exit opening, past the first guide, past the second guide and to the anchor, so that winding and paying out the halyard onto and from the winch raises add lowers the flag.

4. The assembly of claim 3 further comprising a tip guide mounted to the tip of the pole adjacent the exit opening, the halyard engaging the tip guide.

5. The assembly of claim 3 wherein the winch is mounted directly to the support at the base end of the pole.

6. The assembly of claim 3 wherein the inner edge of the flag is secured to the separator member at least the upper and lower ends of the inner edge.

7. The assembly of claim 3 wherein the pole base end is mounted to the support.

8. The assembly of claim 3 wherein the anchor includes a force damping spring coupled to the second end of the halyard.

9. The assembly of claim 3 wherein the pole includes an internal conduit through which the halyard passes.

10. The assembly of claim 3 wherein the first and second guides include first and second pulleys.

11. The assembly of claim 3 wherein the separator member has a generally U-cross-sectional shape, with a base and upstanding legs, the base adjacent the inner edge of the flag and the legs extending away from the flag.

12. The assembly of claim 11 wherein the first and second guides include pulleys mounted to the base and between the legs of the separator member.

13. The assembly of claim 12 wherein a portion of each of the pulleys extends past the legs and wherein the pole includes openings at the exit opening and at the chosen position sized for receipt of the portions to allow the legs of the elongate member to lie against the pole to substantially enclose the portion of the halyard between the pulleys.

14. The assembly of claim 3 further comprising means for mounting the pole to tee support at an acute angle to a vertical.

15. A flagpole assembly comprising a hollow pole including a base end, a tip and an exit opening at the tip;

a tip guide mounted to the tip of the pole;

a winch mounted at the base end of the pole;

a halyard having a first end, connected to the winch, and a second end, the halyard extending from the winch, along the interior of the pole, past the tip guide and through the exit opening;

an anchor mounted to the pole at a chosen position;

a flag having an inner edge; and a flag support assembly, to which the flag is removably secured at the inner edge of the flag to maintain the inner edge extended, for freely movably mounting the flag to the halyard, the flag support assembly including an elongate frame and first and second guide rollers mounted to the elongate frame at spaced apart positions, the halyard extending from the exit opening, around the first guide roller, along the elongate frame, past the second guide roller and to the anchor, the second end of the halyard being connected to the anchor;

whereby winding and unwinding the halyard onto and off of the winch decreases and increases the length of the halyard extending from the exit opening so the flag is raised and lowered.

16. The assembly of claim 15 wherein the pole is oriented at an acute angle to a vertical.

17. The assembly of claim 15 wherein the anchor is a shock absorbing anchor.

18. The assembly of claim 15 wherein:

the elongate frame has a generally U-cross-sectional shape, with a base and upstanding legs, the base adjacent the inner edge of the flag and the legs extending away from the flag;

the first and second guide rollers are mounted to the base and between the legs;

a portion of each of the guide rollers extends past the legs; and the pole includes openings at the exit opening and at the chosen position sized for receipt of the portions of the guide rollers to allow the legs of the elongate member to lie against the pole to substantially enclose the portion of the halyard between the pulleys.

* * * * *